US008009129B2

(12) United States Patent
Matsuo et al.

(10) Patent No.: US 8,009,129 B2
(45) Date of Patent: Aug. 30, 2011

(54) ELECTROLUMINESCENCE DISPLAY APPARATUS

(75) Inventors: Yuichi Matsuo, Mizuho (JP); Takashi Ogawa, Gifu (JP)

(73) Assignee: Semiconductor Components Industries, LLC, Phoenix, AZ (US)

( * ) Notice: Subject to any disclaimer, the term of this patent is extended or adjusted under 35 U.S.C. 154(b) by 821 days.

(21) Appl. No.: 12/058,800

(22) Filed: Mar. 31, 2008

(65) Prior Publication Data

US 2008/0238834 A1 Oct. 2, 2008

(30) Foreign Application Priority Data

Mar. 30, 2007 (JP) ..... 2007-092616

(51) Int. Cl.
*G09G 3/30* (2006.01)

(52) U.S. Cl. ..... 345/78; 250/553; 345/82; 345/204; 345/214

(58) Field of Classification Search ..... 345/76, 345/77, 78, 82, 83, 240, 690, 204, 214; 250/552, 250/553; 315/169.3
See application file for complete search history.

(56) References Cited

U.S. PATENT DOCUMENTS

2005/0237318 A1 10/2005 Inoue et al.
2008/0218453 A1* 9/2008 Miyamoto et al. ..... 345/76
2008/0303754 A1* 12/2008 Murata et al. ..... 345/76

FOREIGN PATENT DOCUMENTS

JP 2005-316408 11/2005

* cited by examiner

*Primary Examiner* — Lun-Yi Lao
*Assistant Examiner* — Tom V Sheng
(74) *Attorney, Agent, or Firm* — Cantor Colburn LLP

(57) ABSTRACT

During a blanking period of a video signal, an element driving transistor for controlling a drive current supplied to an EL element is operated in its saturation region to thereby set the EL element to an emission level, and a current flowing through the EL element at that time is detected. Each current detector includes a current detection amplifier and a successive approximation type AD converter, and a DA converter of the successive approximation type AD converter is commonly shared among a plurality of the AD converters. With this arrangement, sufficient AD converting speed can be attained while using a simple structure to execute current detection for correcting display variations.

12 Claims, 9 Drawing Sheets

ELECTROLUMINESCENCE DISPLAY APPARATUS

CROSS-REFERENCE TO RELATED APPLICATIONS

The entire disclosure of Japanese Patent Application No. 2007-092616 including specification, claims, drawings, and abstract is incorporated herein by reference.

BACKGROUND OF THE INVENTION

1. Field of the Invention

The present invention relates to a display apparatus having an electroluminescence element in each pixel, and particularly to such a display apparatus having a function of correcting a display variation.

2. Description of the Related Art

Electroluminescence (hereinafter referred to as "EL") display apparatuses in which an EL element which is a self-emissive element is employed as a display element in each pixel are expected as a flat display apparatus of the next generation, and are being researched and developed.

After an EL panel is created in which an EL element and a thin film transistor (hereinafter referred to as "TFT") or the like for driving the EL element for each pixel are formed on a substrate such as glass and plastic, the EL display apparatus is subjected to several inspections and is then shipped as a product.

In a current active matrix EL display apparatus having a TFT in each pixel, a brightness unevenness occurs among the EL elements because of display unevenness caused by the TFT, in particular, a variation in the threshold value Vth of the TFT, which is a major cause of reduction in yield. An improvement in the yield of the products is very important, and, thus, reduction in the display defect and display unevenness (display variation) by improving an element design, a material, a manufacturing method, or the like is desired. Attempts have been made, for example, as described in JPA 2005-316408 (hereinafter referred to as "Reference Document 1"), in which, when a display unevenness or the like occurs, the display unevenness is corrected so that the panel is made a non-defective panel.

In the Reference Document 1, the EL panel is caused to emit light, variation in brightness of the pixels is measured, and a data signal (video signal) to be supplied to each pixel is corrected. In addition, as another method, a method is proposed in which a circuit which corrects the variation of Vth of an element driving transistor which controls a current to be supplied to the EL element is provided in each pixel.

The method of measuring the brightness variation by causing the EL panel to emit light and capturing an image of the emission with a camera as described in Reference Document 1 cannot be conducted after shipment, such that this method does not enable execution of corrections with respect to changes of the panel over time or the like. Furthermore, when a resolution of the EL panel is increased and a number of pixels in the EL panel is increased, a number of the measurement and correction target becomes large for measuring the brightness variation for each pixel, and, thus, an increase in the resolution of the camera, an increase in capacity of a storage of correction information, etc. are required.

Moreover, even when the circuit element for compensating Vth is not to be incorporated, it is highly desired to correct the display unevenness caused by the variation in Vth of TFTs.

SUMMARY OF THE INVENTION

An advantage of the present invention is that, at a point after shipment, it is possible to speedily carry out measurement of a display variation in an EL display apparatus and correction of the display variation.

According to one aspect of the present invention, there is provided an electroluminescence display apparatus comprising a display section having a plurality of pixels arranged in a matrix, and a driving section which controls operation of the display section in accordance with a video signal. The driving section comprises a driver which carries out row-direction drive and column-direction drive of the display section, a variation detecting section which detects an inspection result of a display variation in each pixel, and a correcting section which corrects the display variation. Each of the plurality of pixels in the display section comprises an electroluminescence element, and an element driving transistor which is connected to the electroluminescence element and controls a current that flows through the electroluminescence element. In the display section, a plurality of power supply lines for supplying power to electrodes of the electroluminescence elements in the respective pixels are provided along the column direction of the matrix. The variation detecting section comprises an inspection signal generator which generates an inspection signal to be supplied to a pixel in a row to be inspected and supplies the inspection signal to the pixel in the inspected row, a current detection amplifier which detects a current that flows through the electroluminescence element, and an analog-digital converter which converts an analog current detection signal from the current detection amplifier into a digital signal. The current detection amplifier is configured to provide one current detection amplifier in correlation to multiple columns of the matrix, and each current detection amplifier is connected to the power supply lines. During a blanking period, a pixel in a predetermined inspected row is selected by the driver, and a current that flows through the electroluminescence element when an inspection ON signal which serves as the inspection signal and sets the electroluminescence element to an emission level is supplied to the selected pixel is detected by the current detection amplifier via the corresponding power supply line. The analog-digital converter is configured to provide one successive approximation type analog-digital converter in correlation to the multiple columns in a manner corresponding to the current detection amplifier. Each analog-digital converter comprises a comparator which compares the analog current detection signal from the current detection amplifier with a reference signal, a successive approximation register which successively changes a data value from higher-order bit side taking into account a comparison signal from the comparator and supplies the changed value to a digital-analog converter, and a digital-analog converting section which converts a digital signal from the successive approximation register into an analog signal and supplies the converted analog signal as the reference signal to the comparator. The digital-analog converting section is commonly shared by a plurality of the analog-digital converters.

According to another aspect of the present invention, in the above-described apparatus, during the blanking period, the inspection signal generator supplies to the pixel in the inspected row, as the inspection signal, the inspection ON signal and an inspection OFF signal that sets the electroluminescence element to a non-emission level. The current detection amplifier detects an ON current that flows through the electroluminescence element when the inspection ON signal obtained from the power supply line is applied, and an OFF current obtained when the inspection OFF signal is applied. The analog-digital converter converts an output from the current detection amplifier into corresponding digital ON current detection signal and digital OFF current detection signal. A subtractor calculates a difference between the digital ON current detection signal and the digital OFF current detection signal. The correcting section performs correction using a current difference signal in accordance with the calculated current difference between the digital ON current detection signal and the digital OFF current detection signal.

According to another aspect of the present invention, in the above-described apparatuses, the driver comprises a digital-analog display data converter which converts a data signal that is in accordance with a display content and is processed as a digital signal into an analog data signal to be supplied to each pixel in the display section. A resistor string of the digital-analog converting section of the successive approximation type analog-digital converters is commonly shared as a resistor string of the digital-analog display data converter.

According to another aspect of the present invention, in the above-described apparatuses, each of the plurality of pixels further comprises a storage capacitor which retains a gate potential of the element driving transistor. A first electrode of the storage capacitor is connected to a gate of the element driving transistor, and a second electrode of the storage capacitor is connected to a capacitor line provided for each row. The driving section includes a capacitor line controller. The capacitor line controller functions to, during an inspection signal writing period within the blanking period, set a potential of the capacitor line of the inspected row to a first potential that sets the gate potential of the element driving transistor to a non-operation level, and, during a data signal rewriting period until end of the blanking period, set the potential of the capacitor line of the inspected row to a second potential that places the element driving transistor in an operable state.

According to another aspect of the present invention, in the above-described apparatuses, the capacitor line controller further functions to, during the blanking period, fix potentials of all the capacitor lines in the display section other than the capacitor line for the inspected row to the first potential.

According to another aspect of the present invention, in the above-described apparatuses, the current that flows through the electroluminescence element is a cathode current.

According to another aspect of the present invention, in the above-described apparatuses, the electrode of the electroluminescence element is a cathode electrode, and the power supply line is a cathode power supply line.

According to various aspects of the present invention, during a blanking period of a video signal, an element driving transistor for driving an EL element in each pixel is operated in the saturation region so as to cause emission of the EL element, and a current, which may for example be a cathode current, that flows through the EL element during the emission is measured. In an EL element, there is a correlation between the current that flows through the EL element and the emission brightness. Accordingly, by measuring the current that flows through the EL element, it is possible to detect a display variation of the EL element. Further, because this detection is performed during blanking periods that occur between normal display operations, even when display variation (display unevenness) occurs at a point after shipment of the display apparatus, such variation can be corrected in real time.

Furthermore, because the measurement target is the current that flows through the EL element instead of the emission brightness, the measurement can be made with a simple structure. In addition, by switching the EL element ON and OFF and measuring the ON and OFF current values, it is possible to accurately know the ON current with the OFF current as a reference, which facilitates accurate and rapid measurement and correction processes.

As the detection signal from the current detection amplifier is converted into a digital signal in the analog-digital converter before being employed for correction, the correction processing can be speedily executed. Further, because a successive approximation type analog-digital converter is employed as the analog-digital converter, the converting function can be executed with a simple structure. Regarding time required for carrying out the current detection and the analog-digital conversion, simultaneous execution of current detection with respect to a number of columns is enabled by correlating multiple columns with one current detection amplifier, and reduction of processing time is achieved by performing the analog-digital conversion. In this manner, use of a less number of amplifiers and converters as compared to the number of pixels and columns contributes to downsizing of the display apparatus.

Moreover, concerning the digital-analog converting section of the successive approximation type analog-digital converters provided in a plural number over the entire panel, by commonly sharing the digital-analog converting section among these analog-digital converters, reduction in area of the analog-digital converters is accomplished.

BRIEF DESCRIPTION OF THE DRAWINGS

A preferred embodiment of the present invention will be described in detail by reference to the drawings, wherein.

DESCRIPTION OF THE PREFERRED EMBODIMENT

A preferred embodiment of the present invention (hereinafter referred to as "embodiment") will now be described with reference to the drawings.

[Detection Principle]

Figure 1:
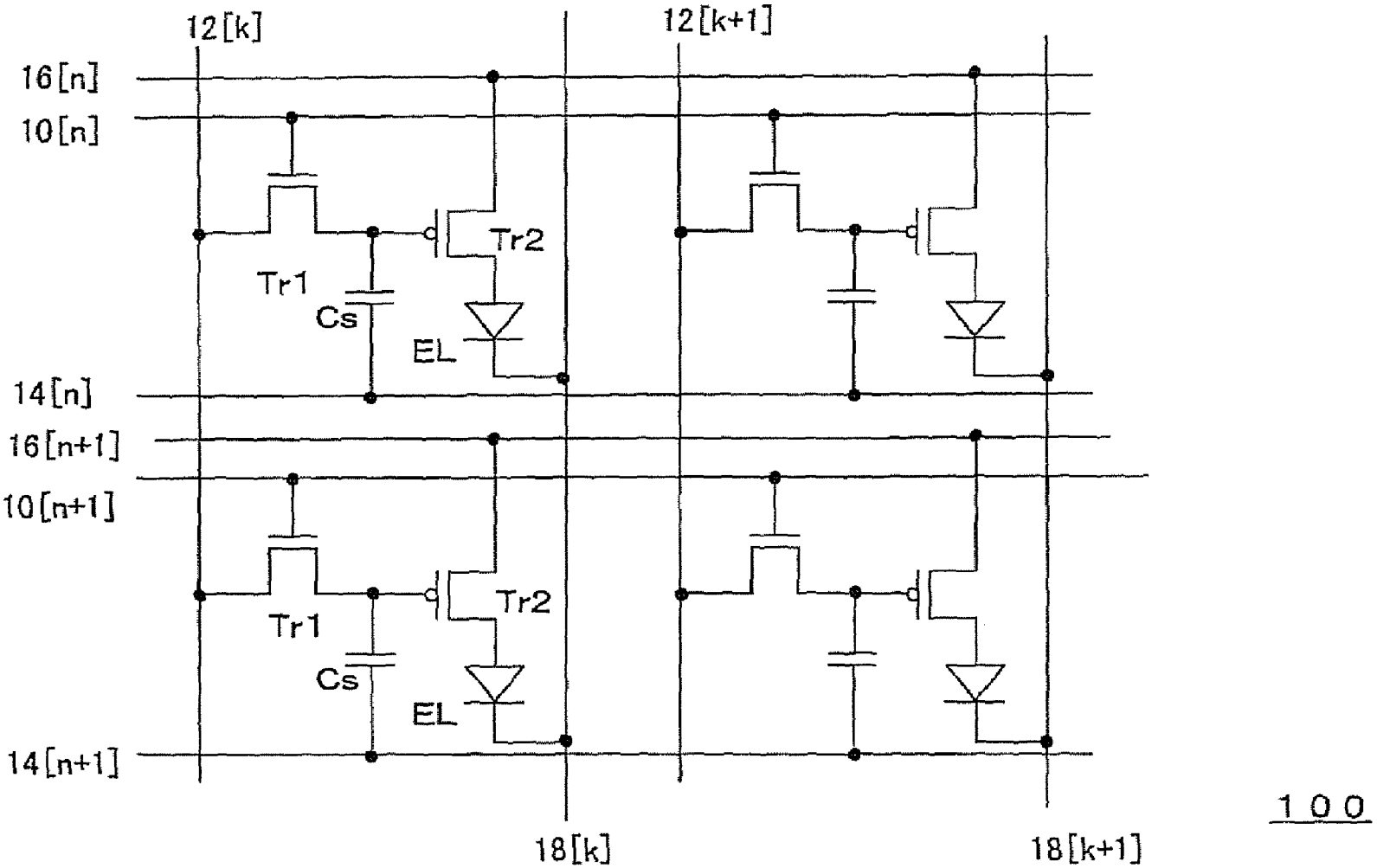
FIG. 1 is an equivalent circuit diagram for explaining an example schematic circuit structure of an EL display apparatus according to a preferred embodiment of the present invention.

In the embodiment, a display apparatus is an active matrix organic electroluminescence (EL) display apparatus, and a display section having a plurality of pixels is formed on an EL panel 100. FIG. 1 is a diagram showing an example equivalent circuit structure of an active matrix EL display apparatus according to the embodiment. A plurality of pixels are arranged in the display section of the EL panel 100 in a matrix form. Formed along a horizontal (H) scan direction (row direction) of the matrix are a selection line (gate line GL) 10 on which a selection signal is sequentially output, and a power supply line 16 (VL) for supplying a drive power supply PVDD to an organic EL element 18 (hereinafter simply referred to as "EL element") which is an element to be driven. A data line 12 (DL) on which a data signal (Vsig) is output is formed along a vertical (V) scan direction (column direction). Further, along the column direction, a cathode power supply line 18 (CV) is formed in stripe patterns integrally with cathode electrodes of the respective EL elements.

Each pixel is provided in a region approximately defined by these lines. Each pixel comprises an EL element 18 as an element to be driven, a selection transistor Tr1 formed by an n-channel TFT (hereinafter referred to as "selection Tr1"), a storage capacitor Cs, and an element driving transistor Tr2 formed by a p-channel TFT (hereinafter referred to as "element driving Tr2").

The selection Tr1 has a drain connected to the data line 12 which supplies a data voltage (Vsig) to the pixels along the vertical scan direction, a gate connected to the gate line 10 which selects pixels along a horizontal scan line, and a source connected to a gate of the element driving Tr2.

A source of the element driving Tr2 is connected to the power supply line 16 and a drain of the element driving Tr2 is connected to an anode of the EL element. A cathode of the EL element is formed common for the pixels and is connected to a cathode power supply CV.

The EL element 18 has a diode structure and comprises a light emitting element layer between a lower electrode and an upper electrode. The light emitting element layer comprises, for example, at least a light emitting layer having an organic light emitting material, and a single layer structure or a multilayer structure of 2, 3, or 4 or more layers can be employed for the light emitting element layer depending on characteristics of the materials to be used in the light emitting element layer or the like. In the present embodiment, the lower electrode is patterned into an individual shape for each pixel, functions as the anode, and is connected to the element driving Tr2. The upper electrode is common to a plurality of pixels and functions as the cathode.

In an active matrix EL display apparatus having the circuit structure as described above in each pixel, if an operation threshold value Vth of the element driving Tr2 varies, even when a same data signal is supplied to the pixels, the same current is not supplied from the drive power supply PVDD to the EL element, which causes brightness variation (display variation).

Figure 2B:
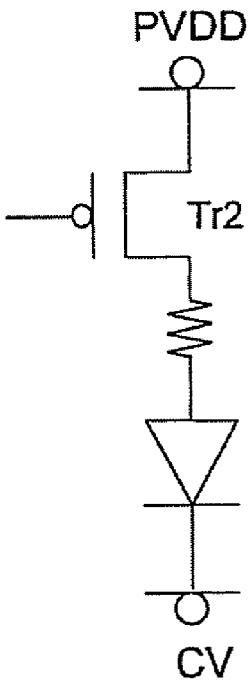
FIGS. 2A and 2B are diagrams for explaining a principle of measurement of a characteristic variation of an element driving transistor according to a preferred embodiment of the present invention.
Figure 2A:
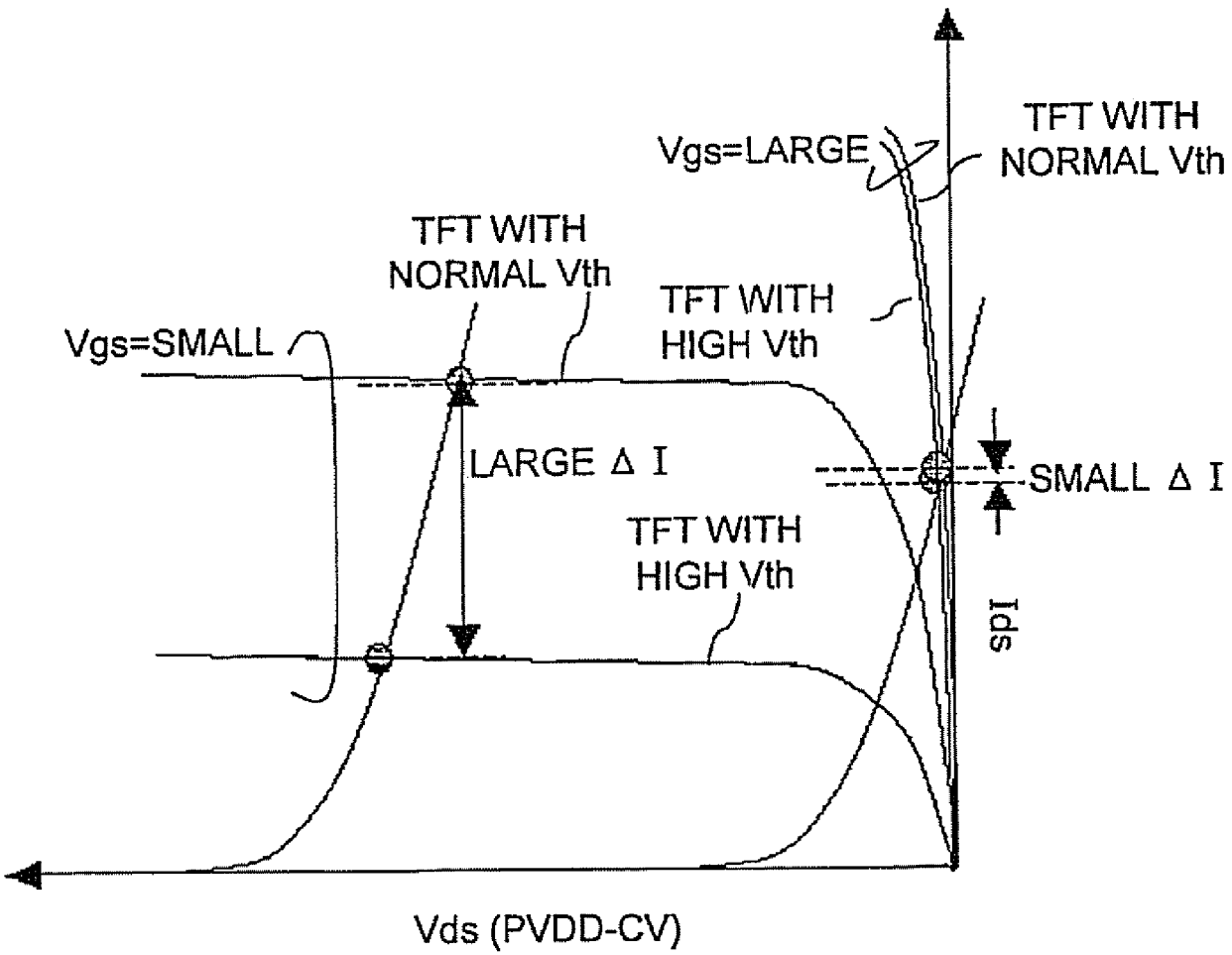

FIGS. 2A and 2B show an equivalent circuit of a pixel (FIG. 2B) and Vds-Ids characteristics of the element driving Tr2 and the EL element (FIG. 2A) when a characteristic variation (variation in a current supplying characteristic; for example, variation in the operation threshold value Vth) occurs in the element driving Tr2. When the operation threshold value Vth of the element driving Tr2 varies, the circuit can be considered as having a resistance which is larger or smaller than that in the normal case is connected to a drain side of the element driving Tr2 as shown in FIG. 2B. Therefore, although the characteristic of the current (in the present embodiment, cathode current Icv) flowing through the EL element is not different from that of the normal pixel, the current actually flowing through the EL element would vary according to a characteristic variation of the element driving Tr2.

When a voltage applied to the element driving Tr2 satisfies a condition of Vgs−Vth<Vds, the element driving Tr2 operates in a saturation region. In a pixel having the operation threshold value Vth of the element driving Tr2 which is higher than that for a normal pixel, the current Ids between the drain and the source of the transistor is smaller than that for a normal transistor and an amount of supplied current to the EL element, that is, the current flowing through the EL element is smaller than that for a normal pixel (a large ΔI), as shown in FIG. 2A. As a result, the emission brightness of the pixel is reduced compared to the emission brightness of the normal pixel and a display variation occurs.

On the other hand, in a pixel having an operation threshold value Vth of the element driving Tr2 which is smaller compared to that of the normal pixel, the current Ids between the drain and the source of the transistor is larger than that of a normal transistor, the current flowing through the EL element is larger than that of the normal pixel, and the emission brightness is higher.

When a voltage applied to the element driving Tr2 satisfies a condition of Vgs−Vth>Vds, the element driving Tr2 operates in a linear region. In the linear region, a difference in the Ids-Vds characteristic between an element driving Tr2 having a higher threshold value Vth and an element driving Tr2 having a lower threshold value Vth is small, and, thus, a difference in the amount of supplied current to the EL element (ΔI) is also small. Because of this, the EL elements show similar emission brightness regardless of the presence or absence of the characteristic variation in the element driving Tr2, and, thus, it is difficult to detect a display variation caused by the characteristic variation in the linear region. By operating the element driving Tr2 in the saturation region as described above, it is possible to detect the display variation caused by the characteristic variation in the element driving Tr2.

The display variation can be reliably corrected by correcting the data signal to be supplied to each pixel based on the detected current value. For example, when the threshold value |Vth| of the element driving Tr2 is smaller than that of a normal pixel, the emission brightness of the EL element when a reference data signal is supplied is higher than that of the normal pixel. Therefore, in this case, the brightness variation can be corrected by reducing the absolute value |Vsig| of the data signal according to a shift of the threshold value |Vth| with respect to the reference. When, on the other hand, the threshold value |Vth| of the element driving Tr2 is higher than that of a normal pixel, the brightness variation can be corrected by increasing the absolute value |Vsig| of the data signal according to the shift of the threshold value |Vth| with respect to the reference.

In the above-described circuit structure, a p-channel TFT is employed as the element driving transistor. However, the present invention is not limited to such a configuration, and, alternatively, an n-channel TFT may be used. In addition, although in the above-described pixel circuit, an example structure is described in which two transistors including a selection transistor and a driving transistor are employed as transistors in a pixel, the present invention is not limited to a structure with two transistors or to the above-described circuit structure.

According to the present embodiment, as described above, brightness variation of an EL element caused by characteristic variation of an element driving Tr in each pixel is detected from the cathode current of the EL element, and the detected brightness variation is corrected. These current detection (variation detection) and correction are executed during normal operation of the display apparatus within one blanking period of a video signal.

More specifically, the cathode current detection processing is performed within one blanking period of a video signal by selecting one certain row of a display section as the inspected row, supplying an inspection signal to a corresponding pixel, and detecting the cathode current Icv flowing from the cathode electrode of the EL element to the cathode terminal within the pixel. The blanking period is either a vertical blanking period or a horizontal blanking period. While either of the blanking periods may be used, from the perspective of placing more weight on allowing sufficient time considering the current detection processing speed, the following explanation is made referring to an example inspection method performed within a vertical blanking period. Further, according to the present embodiment, in order to reduce the amount of time required for obtaining inspection results for all the pixels, the cathode electrode is divided into multiple strips along the column direction as described above (divided corresponding to each column in the example of FIG. 1), and the inspection is executed in units of columns in a time division manner.

In a case in which the cathode electrode is divided into multiple strips corresponding to every column and the cathode current detection is to be executed during vertical blanking periods, within one vertical blanking period, an inspection signal is supplied to respective ones of all the pixels in certain one inspected row (nth row), and the cathode current for each column is detected. By performing this process in every vertical blanking period while changing the selected row to execute the process with respect to all rows, the cathode current is obtained for all the pixels in the panel. By performing this method in a VGA panel when one current detector is provided corresponding to each column of the matrix in 1:1 relationship, cathode current detection for all pixels can be executed in a total of approximately 8 seconds (=1/60 seconds×480 rows).

Providing one current detector for each column of the matrix in 1:1 relationship means that it is necessary to provide current detectors in a number equivalent to the number of columns, and this may possibly serve as an obstacle to downsizing of the display apparatus. Accordingly, in the present embodiment, a successive approximation type AD converter, which has a simple structure, is employed as the analog-digital (AD) converter of each current detector, and a DA converting section employed in the AD converter circuit is commonly shared by a plurality of AD converter circuits, so as to reduce the area occupied by the current detectors.

While a successive approximation type AD converter has a simple structure as noted above, because this AD converter performs value comparison processing sequentially from the most significant bit (MSB), the amount of time required for the processing increases as the number of bits of the digital signal increases. Accordingly, it is not easy to carry out current detection and obtain resulting digital signals with respect to all columns of pixels in the display section within one inspection period (such as a vertical blanking period during one vertical scan (V) period) using only a single current detector.

In light of the above, according to the present embodiment, while employing successive approximation type AD converters as the AD converters of the current detector, in order to carry out current detection and correction regarding all the pixels in a reduced amount of time, one current detector is assigned corresponding to every multiple columns, such that processing speed can be increased by performing time-shared processing.

Referring for example to a QVGA panel (240 rows×320 columns×RGB) having a ¼ size of a VGA panel, a total of 960 columns for R, G, and B may be divided into 10 groups to carry out the current detection. More specifically, one current detector may be provided corresponding to every 96 columns. With this arrangement, while the current detection regarding all the pixels can be executed in approximately 40 seconds (1/60 seconds×240×10), the number of current detectors provided need only be 10, such that it is possible to execute the current detection and variation correction as described below without obstructing downsizing of the display apparatus. The cathode power supply line 18 may be divided in accordance with the number of groups into which the columns are divided, i.e., divided corresponding to every grouped number of columns into at least a number equal to the number of groups. However, from the perspective of enabling to adapt to changes in the number of divided groups made after shipment, and from the perspective of reducing differences in structures of the respective pixels within the display section, the present embodiment is configured such that one cathode power supply line 18 is provided corresponding to each column as shown in FIG. 1, and each current detector is connected to a number of cathode power supply lines 18 corresponding to the correlated number of columns.

[Example Apparatus Configuration]

Figure 3:
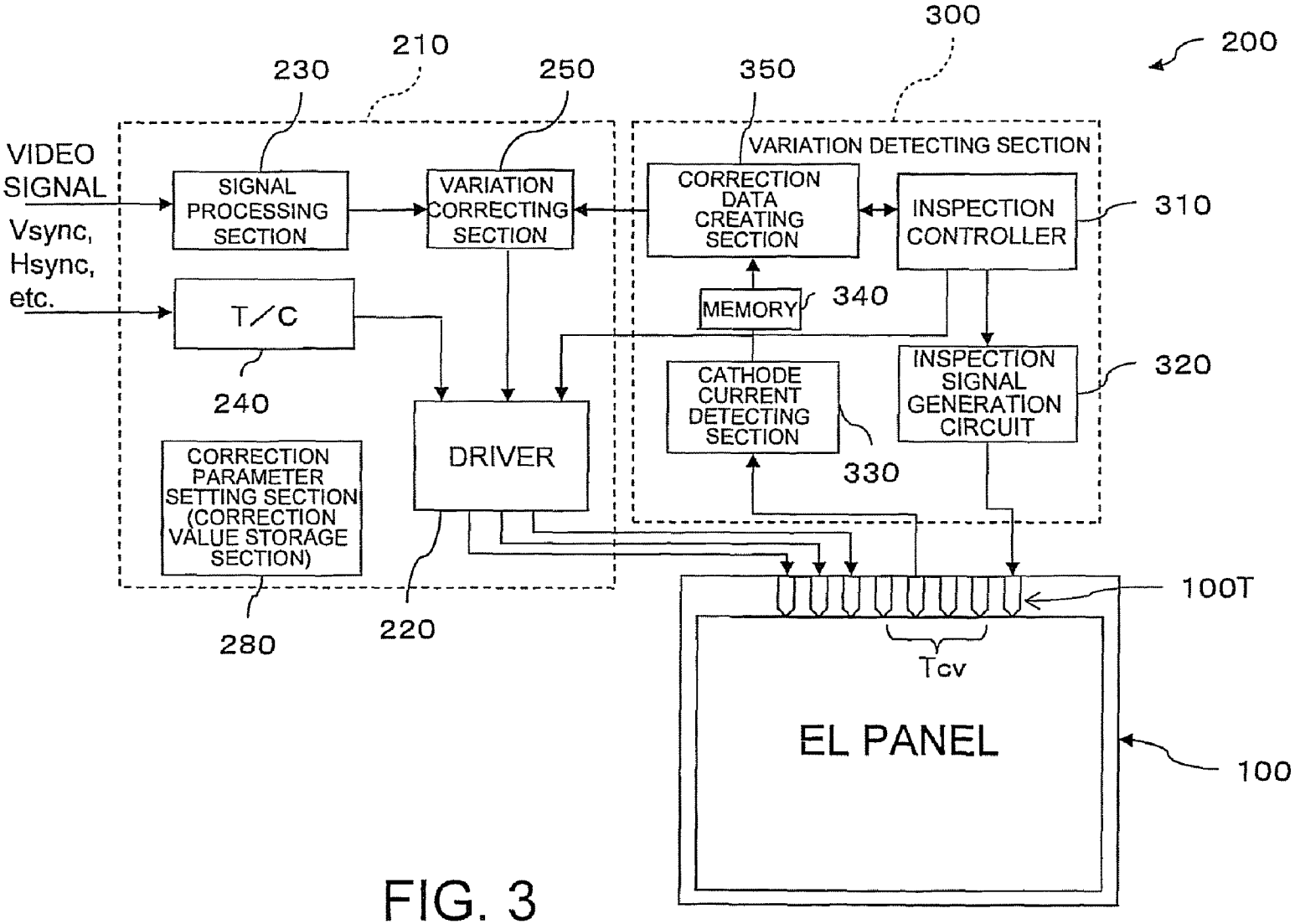
FIG. 3 is a diagram showing an example configuration of an EL display apparatus provided with the display variation correction function according to a preferred embodiment of the present invention.
Figure 4:
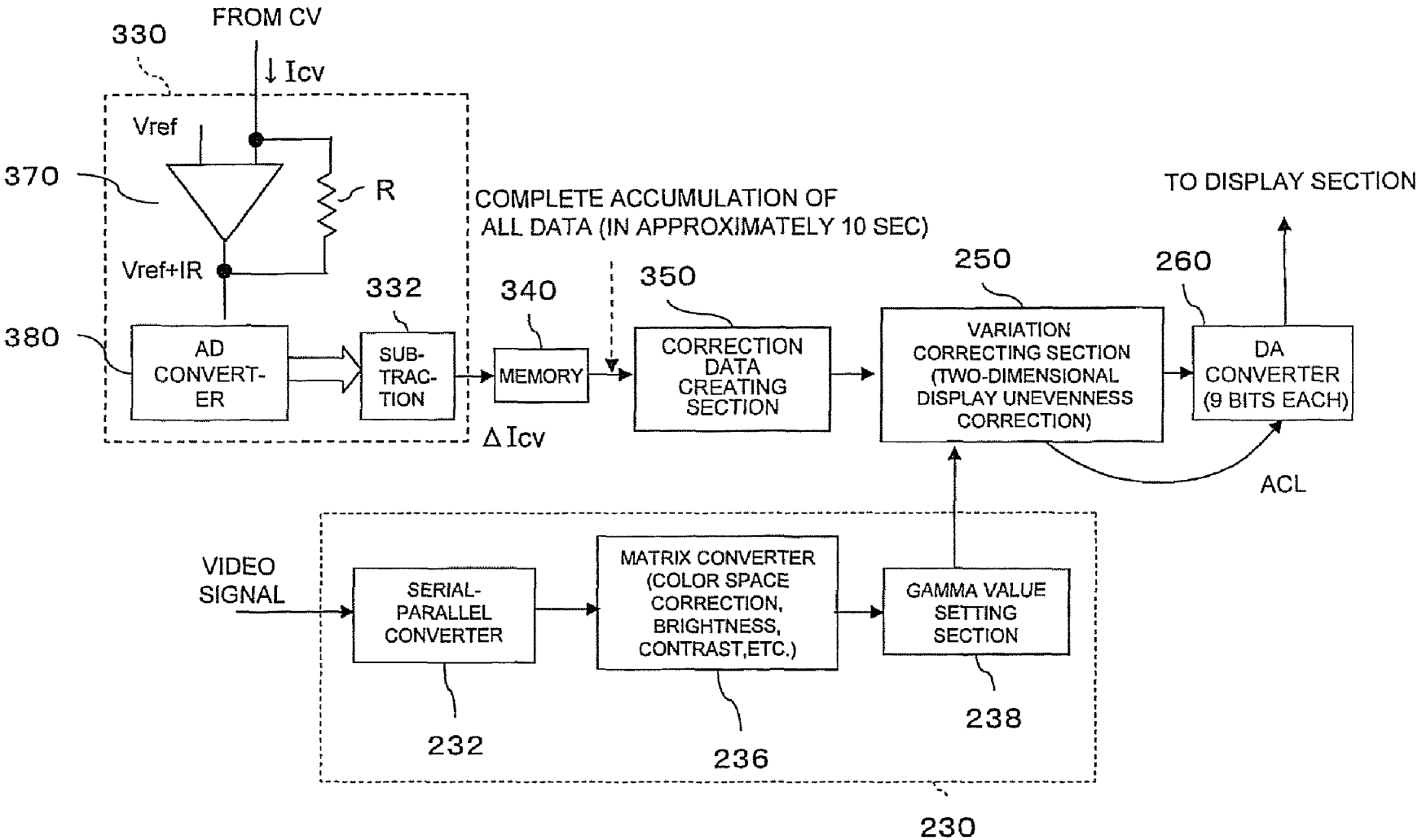
FIG. 4 is a diagram showing a part of a more specific configuration of the driving section of FIG. 3.

An example structure of an electroluminescence display apparatus having a variation correction function according to an embodiment of the present invention is next described referring to FIGS. 3 and 4. FIG. 3 shows one example of an overall configuration of an electroluminescence display apparatus. This display apparatus comprises an EL panel 100 provided with a display section having pixels as described above, and a driving section 200 that controls display and operation in the display section. The driving section 200 schematically comprises a display controller 210 and a variation detecting section 300.

The display controller 210 includes a signal processor 230, a variation correcting section 250, a timing signal creating (T/C: Timing controller) section 240, a driver 220, and the like.

The signal processor 230 generates a display data signal suitable for displaying on the EL panel 100 based on a color video signal provided from outside. The timing signal creating section 240 generates, based on a dot clock signal (DOTCLOCK), synchronization signals (Hsync, Vsync), and the like, various timing signals such as H-direction and V-direction clock signals CKH, CKV and horizontal and vertical start signals STH, STV, which are required in the display section. The variation correcting section 250 uses a correction data supplied from the variation detecting section 300 to correct a video signal in accordance with a characteristic of the EL panel which is the target to be driven.

The driver 220 generates, based on the various timing signals obtained from the timing signal creating section 240, signals for driving the EL panel 100 in the H direction and the V direction, and supplies the generated signals to the pixels. Further, the driver 220 also supplies a corrected video signal supplied from the variation correcting section 250 as a data signal (Vsig) to a corresponding pixel. As shown for example in FIG. 1, the driver 220 comprises an H driver 220H that controls drive of the display section in the H (row) direction and a V driver 220V that controls drive in the V (column) direction. As can be seen in FIG. 1, the H driver 220H and the V driver 220V may be integrated on the panel substrate together with the pixel circuit of FIG. 1 in a peripheral region around the display area of the EL panel 100. Alternatively, the H driver 220H and the V driver 220V may be composed as a separate unit from the EL panel 100 on an integrated circuit (IC) together with or separately from the driving section 200 of FIG. 3.

The variation detecting section 300 operates during a blanking period under a normal use environment of the EL panel 100 to detect a display variation and obtain a correction value. In the example of FIG. 3, the variation detecting section 300 comprises an inspection controller 310 that controls variation inspection, an inspection signal generation circuit 320 that generates an inspection signal and supplies the generated signal to a pixel in an inspected row of the EL panel, a cathode current detector 330 that detects a cathode current obtained from a cathode electrode when the inspection signal is supplied, a memory 340 that stores a cathode current detection result, a correction data creating section 350 that creates a correction data based on the detected cathode current, and the like. Further, a control signal generation circuit for generating a selection signal necessary for selecting and inspecting a pixel of an inspected row when performing the inspection and a control signal for performing electric potential control of a predetermined line as described below may be integrated within the driver 220 and may be caused to operate in response to control by the detection controller 310. This structure may be executed as a control signal generation circuit provided exclusively for inspection, or may alternatively be executed by the inspection controller 310.

FIG. 4 shows a part of a more specific configuration of the driving section 200 of FIG. 3. One cathode current detector 330 is provided in correlation to multiple columns of the matrix of the display section, and each cathode current detector 330 includes a current detection amplifier 370, an analog-digital (AD) converter 380, and a subtractor 332. In the example shown in FIG. 4, the current detection amplifier 370 includes a resistor R provided between the amplifier output side and the current input side. The cathode current Icv obtained from a corresponding cathode electrode terminal Tcv among the plurality of cathode electrode terminals Tcv of the EL panel is acquired as a current detection data (voltage data) expressed by [Vref+IR] based on voltage [IR] generated when the cathode current Icv flows in the resistor R and the reference voltage Vref. The AD converter 380 converts the current detection data acquired in the current detection amplifier 370 into a digital signal having a predetermined number of bits. As described in detail below, the AD converter 380 is configured with a successive approximation type AD converter circuit, and the DA converting section is commonly shared by a plurality of AD converters 380.

The digital detection data obtained from the AD converter 380 is supplied to the subtractor 332. As the inspection signal, by supplying an inspection ON display signal which sets the EL element to an emission level, in principle it is possible to detect a display unevenness in accordance with a variation in the threshold value of the element driving Tr2. However, increased inspection speed and accuracy can be achieved by supplying, as the inspection signal to a pixel in the inspected row, the inspection ON display signal and also an inspection OFF display signal which sets the EL element to a non-emission level, detecting an ON cathode current obtained during application of the inspection ON display signal and an OFF cathode current obtained during application of the inspection OFF display signal, and obtaining the difference ΔIcv. Inspection speed and accuracy can be increased in this manner because the OFF cathode current $Icv_{off}$ is measured, and the ON cathode current $Icv_{on}$ during application of the ON display signal is determined relatively using this $Icv_{off}$ as a reference. This eliminates the necessity to accurately determine the absolute value of the ON cathode current $Icv_{on}$ or to separately measure an OFF cathode current $Icv_{off}$ for use as a reference. In other words, by using the difference between the ON cathode current and the OFF cathode current (the cathode current difference), any influences of characteristic variation of the current detection amplifier 370 or the like can be canceled from the cathode current difference, and no reference value for determining the absolute value of the ON cathode current is necessary. More specifically, $Vref+Icv_{on}*R$ and $Vref+Icv_{off}*R$ are respectively acquired and digitally converted in the AD converter 380. The subtractor 332 performs subtraction with respect to the sequentially obtained digital current detection signals corresponding to the ON cathode current and the OFF cathode current, to finally obtain $(Icv_{on}-Icv_{off})*R$, such that $\Delta Icv=Icv_{on}-Icv_{off}$ can be obtained.

The cathode current detection data regarding all pixels are accumulated in the memory 340 in approximately 40 seconds, according to one example described above. The memory 340 stores these cathode current detection data for all pixels at least until new cathode current detection data for all pixels are subsequently obtained.

The correction data creating section 350 creates, based on the cathode current detection data for each pixel accumulated in the memory 340, a correction data for correcting a display variation caused by a characteristic variation of the element driving Tr2 in each pixel.

Figure 5:
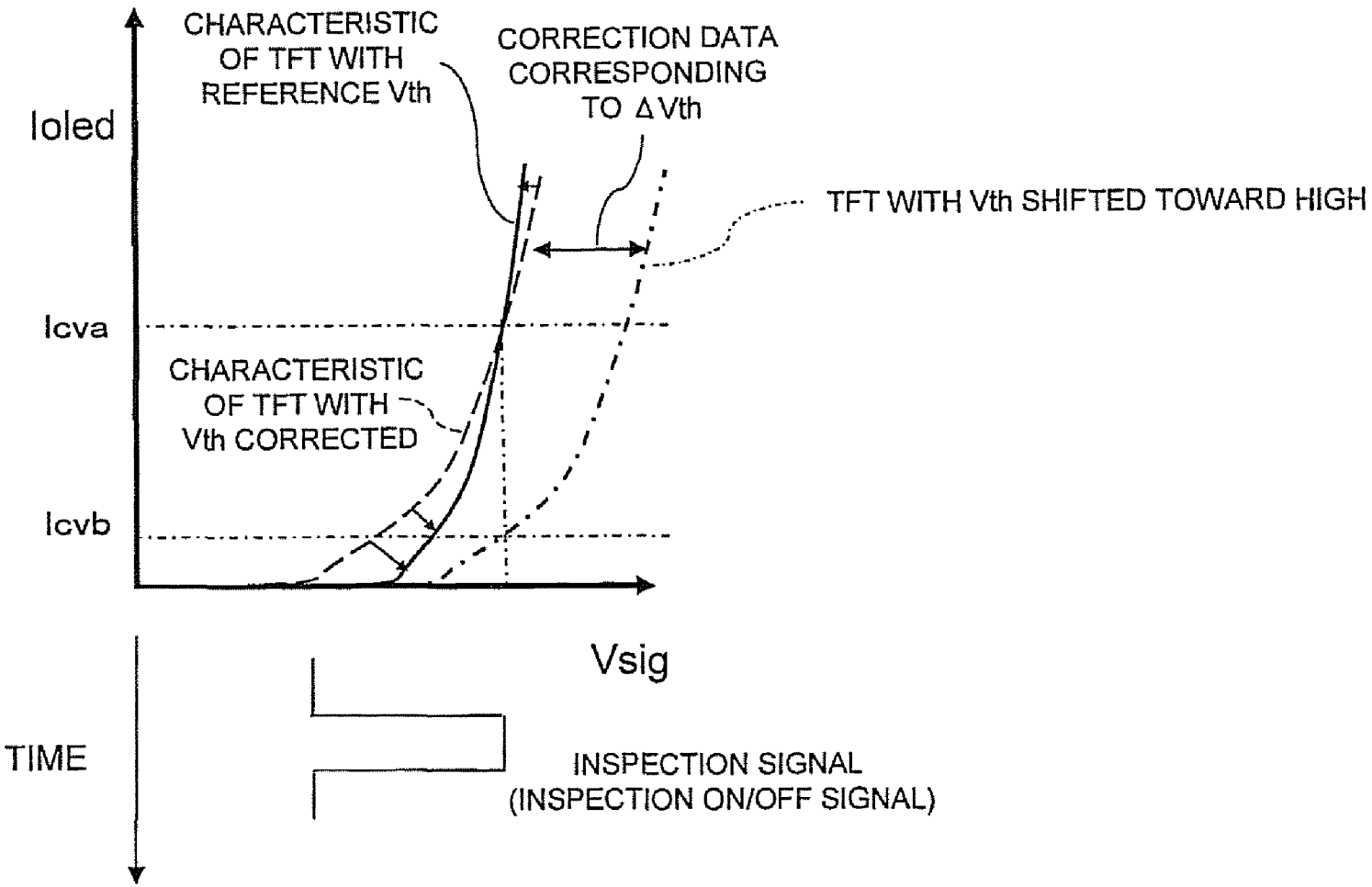
FIG. 5 is a diagram for explaining a shift in an operation threshold value of an element driving transistor Tr2 and a method for correcting the shift.

For example, as shown in FIG. 5, upon application of an identical inspection signal which sets an EL element to an emission state, when the element driving Tr2 of the measured pixel has a threshold value Vth that is shifted toward a higher voltage side than the threshold value Vth of a normal element driving Tr2 (as shown by a dot-dash line in FIG. 5), the cathode current obtained in the shifted pixel becomes Icvb, whereas the cathode current in a normal pixel is Icva.

Accordingly, when the operation threshold value Vth of the element driving Tr2 is shifted (i.e., deviated) from that of a normal TFT as shown in FIG. 5, the correction data creating section 350 obtains, from the cathode current detection data, a correction data for compensating the deviation of the operation threshold value Vth. Conceptually, based on this correction data, the voltage of the data signal supplied to each pixel is caused to be shifted in accordance with the amount of deviation in the operation threshold value Vth, so as to attain the characteristic state shown by a dashed line in FIG. 5.

One example method of creating a correction data for shifting a voltage of a data signal is described as follows. First, a deviation of the operation threshold value of each pixel from a reference may be calculated using equation (1) below.

$$V(\Delta Icv) = V(\Delta Icvref) \times \left(\frac{Vsigon - Vth(i)}{Vsigon}\right)^{\gamma} \quad (1)$$

In equation (1), Vth(i), V(Icv), Vsigon, and γ are defined as below.

Vth(i): Deviation of the operation threshold value of the inspected pixel.

V(ΔIcv): ON-OFF cathode current value of the inspected pixel (voltage data).

V(ΔIcvref): Reference ON-OFF cathode current value (voltage data).

Vsigon: Tone level of the inspection ON display signal.

γ: Emission efficiency characteristic of the display panel (constant value).

When, for example, the tone level [Vsigon] of the inspection ON display signal is set to 240 (in a range of 0-255), based on this tone level 240, the ON-OFF cathode current value of the inspected pixel [V(ΔIcv)], the reference ON-OFF cathode current value [V(ΔIcvref)], and the constant value of emission efficiency characteristic γ, it is possible to calculate using the above equation (1) the deviation Vth(i) of the operation threshold value of each pixel with respect to the reference. For example, it is assumed that, for pixels A though E, the following amounts of threshold value deviation Vth(i) from the reference are obtained:

Vth(A)=0

Vth(B)=13.4

Vth(C)=17.0

Vth(D)=3.2

Vth(E)=20.7

In this example, the deviation of the threshold value for pixel E is the highest. In this case, when data signals having an identical tone level are supplied to the respective pixels, pixel E emits at the lowest brightness in the display section. Meanwhile, there exists a limit regarding the maximum value of data signal that can be supplied to the pixels. Accordingly, using the $Vth(i)_{max}$ of pixel E as a reference, the maximum data signal value $Vsig_{max}$ is determined. In other words, the maximum value $Vth(i)_{max}$ is selected from among the Vth(i) values obtained for the respective pixels, and a difference ΔVth(i) of the Vth value for each of all other pixels with respect to the value $Vth(i)_{max}$ is obtained. Subsequently, the maximum value $Vsig_{max}(i)$ of data signal that should be supplied to each pixel is calculated by subtracting the obtained ΔVth(i) from $Vsig_{max}$ to determine [$Vsig_{max}$−ΔVth(i)]. Further, the calculated result is reflected in an initial correction data RSFT(init) shown in equation (2) explained further below, and is supplied to the variation correcting section 250.

A set of the initial correction data for the respective pixels created in the correction data creating section 350 as described above are stored in a correction value storage section 280 shown in FIG. 3, for example.

The variation correcting section 250 uses these stored correction data until new correction data are obtained, to execute variation correction for each pixel (two-dimensional display variation correction) with respect to a video signal supplied from the signal processor 230.

The signal processor 230 is a signal processing circuit which generates a display signal suitable for displaying on the EL panel 100 based on a color video signal provided from outside, and may for example have a configuration as shown in FIG. 4. A serial-parallel converter 232 converts an externally-supplied video signal into a parallel data, and the resulting parallel data is supplied to a matrix converter 236. In the matrix converter 236, when the externally-supplied video signal has YUV format, an offset processing in accordance with the color tone displayed on the EL panel is carried out. Y is a luminance signal, U denotes a difference between the luminance signal and a blue component, and V denotes a difference between the luminance signal and a red component. In YUV format, these three information items are used to express colors. Further, the matrix converter 236 performs converting processing such as data reduction (thinning) of the parallel video signal into a format suitable for the EL panel 100. The matrix converter 236 also executes color space correction, brightness and contrast correction, and the like. Subsequently, a gamma value setting section 238 performs setting of a γ value in accordance with the EL panel 100 (gamma correction) with respect to the video signal supplied from the matrix converter 236. The gamma-corrected video signal is supplied to the above-noted variation correcting section 250.

In one example, the variation correcting section 250 uses equation (2) below to execute the two-dimensional display variation correction.

$$R_SFT(0) = \frac{\frac{ADJ_SFT}{16} \times (512 - Rin) + Rin}{512} \times RSFT(init) \quad (2)$$

In equation (2), RSFT(init) denotes an initial correction data which reflects the correction value obtained in the correction data creating section 350 (when there exists a correction data for each pixel before shipment from the factory, that correction data is also reflected). Rin denotes an input video signal supplied from the signal processor 230, and, in this example, is a 9-bit data having any value from among 0-511. ADJ_SFT denotes a correction value adjusting (weighting) parameter, and R_SFT denotes a display data after being subjected to the two-dimensional display variation correction.

Figure 6:
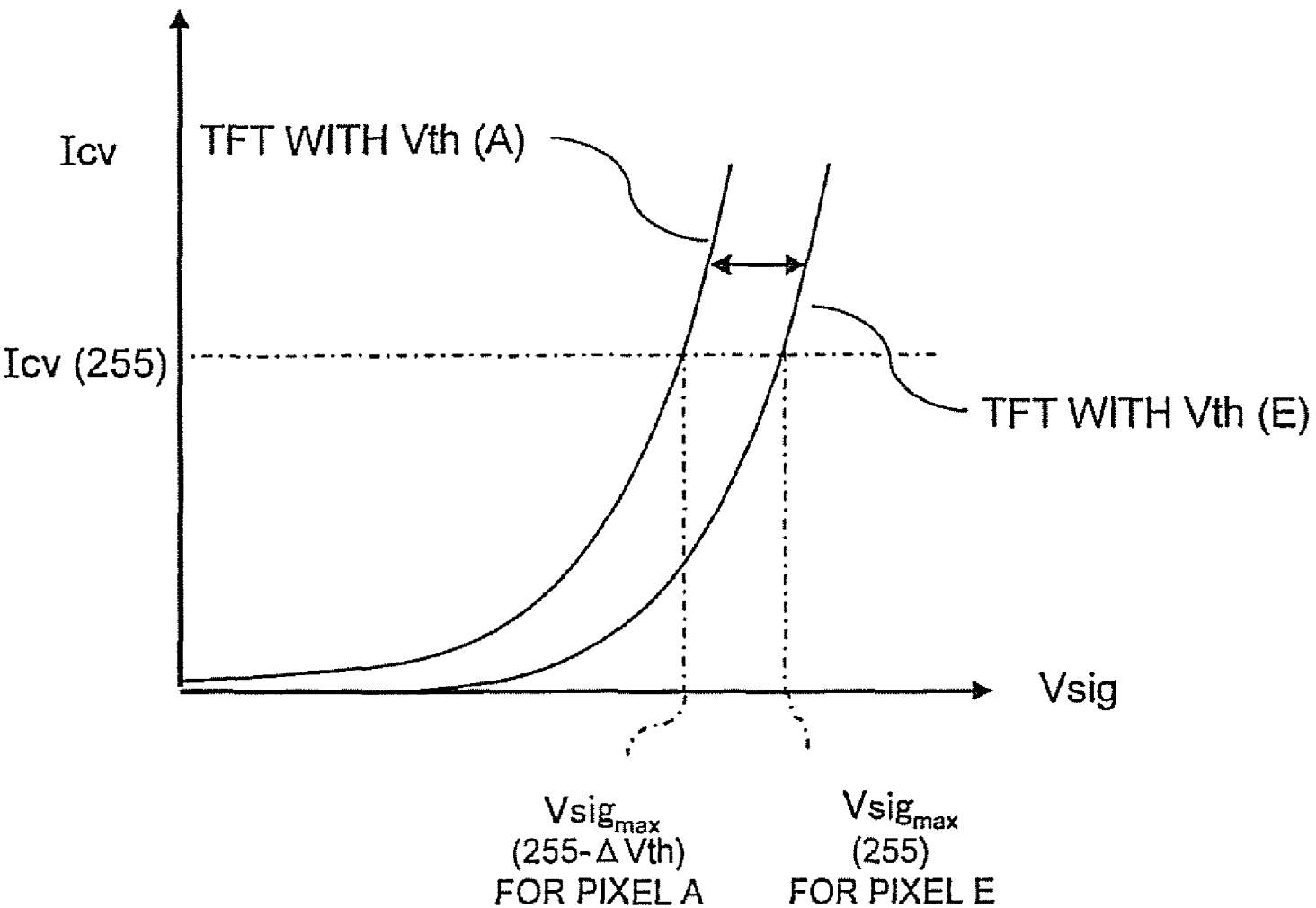
FIG. 6 is a diagram for explaining a method for obtaining a correction data corresponding to a shift in the operation threshold value.

As can be understood from FIG. 5, when a deviation occurs in the operation threshold value Vth of the element driving Tr2, the slope β of the characteristic curve of this TFT differs from the slope β of the characteristic curve of a normal TFT. As such, by simply shifting the data signal by the amount of deviation of Vth as shown in FIG. 6, accurate tone expression cannot be achieved. Accordingly, the variation correcting section 250 employs the above equation (2) or the like to take into account the slope β (i.e., the weighting parameter in the above equation (2)), so as to execute an optimal correction in accordance with the actual video signal value (luminance level), thereby accomplishing an adjustment such that a cathode current that results in a characteristic corresponding to a normal TFT characteristic flows through the EL element. With this correction, it is possible to reliably prevent a problem such as whitish display on the lower tone level side (deviation toward the higher tone level side) caused by a difference in the slope of the TFT characteristic when the correction is executed simply by a shift by ΔVth.

The video signal after being subjected to the two-dimensional display variation correction as described above is supplied to a digital-analog (DA) converter 260, and is converted into an analog data signal to be supplied to each pixel. This analog data signal, which is data that should be output to a corresponding data line 12 of the display section, is output to a video line provided in the panel 100, and is supplied to the corresponding data line 12 in accordance with control by the V driver 220V.

[Cathode Current Detector]

Figure 7:
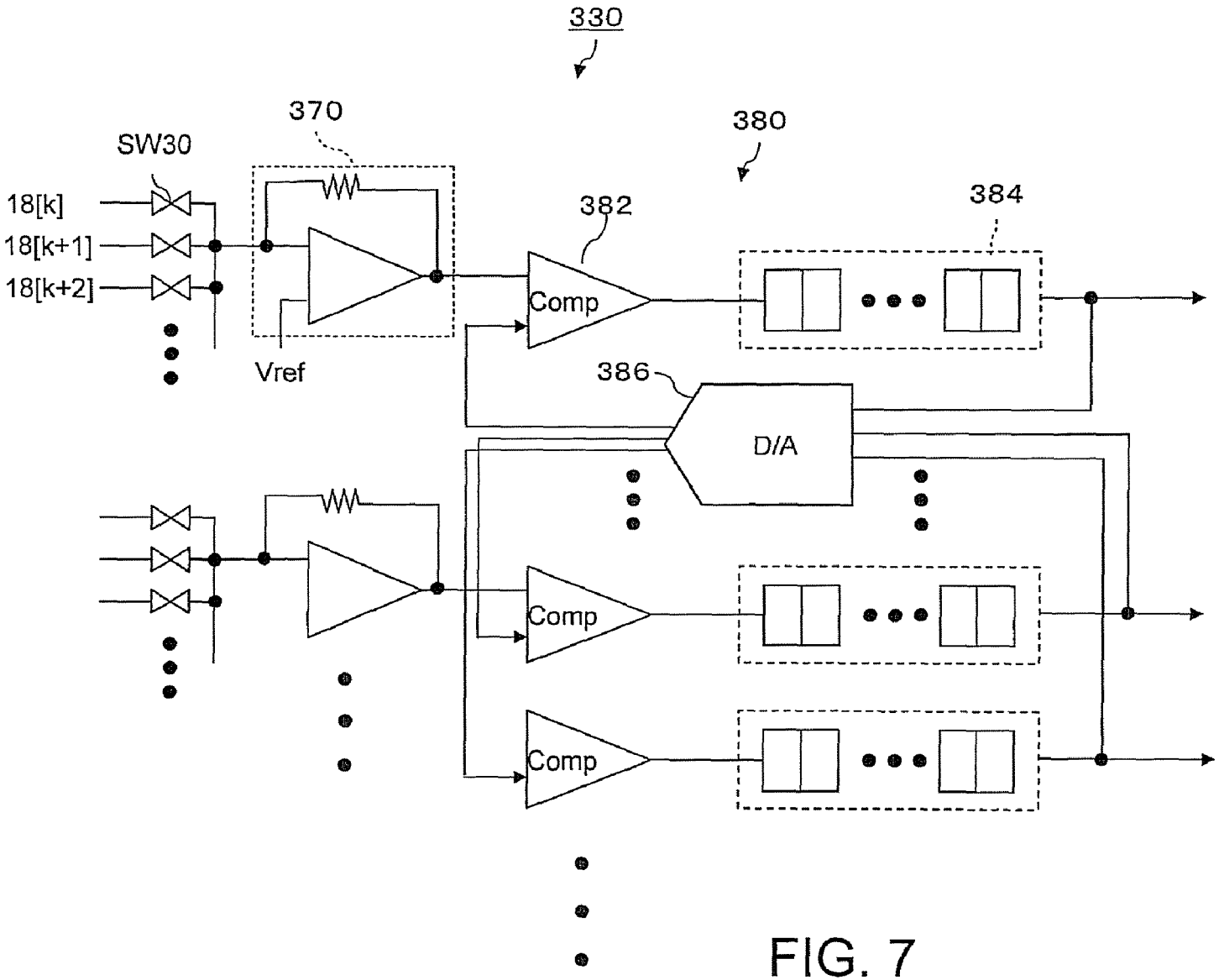
FIG. 7 is a diagram showing a schematic configuration of the current detector 330 according to a preferred embodiment of the present invention.
Figure 8:
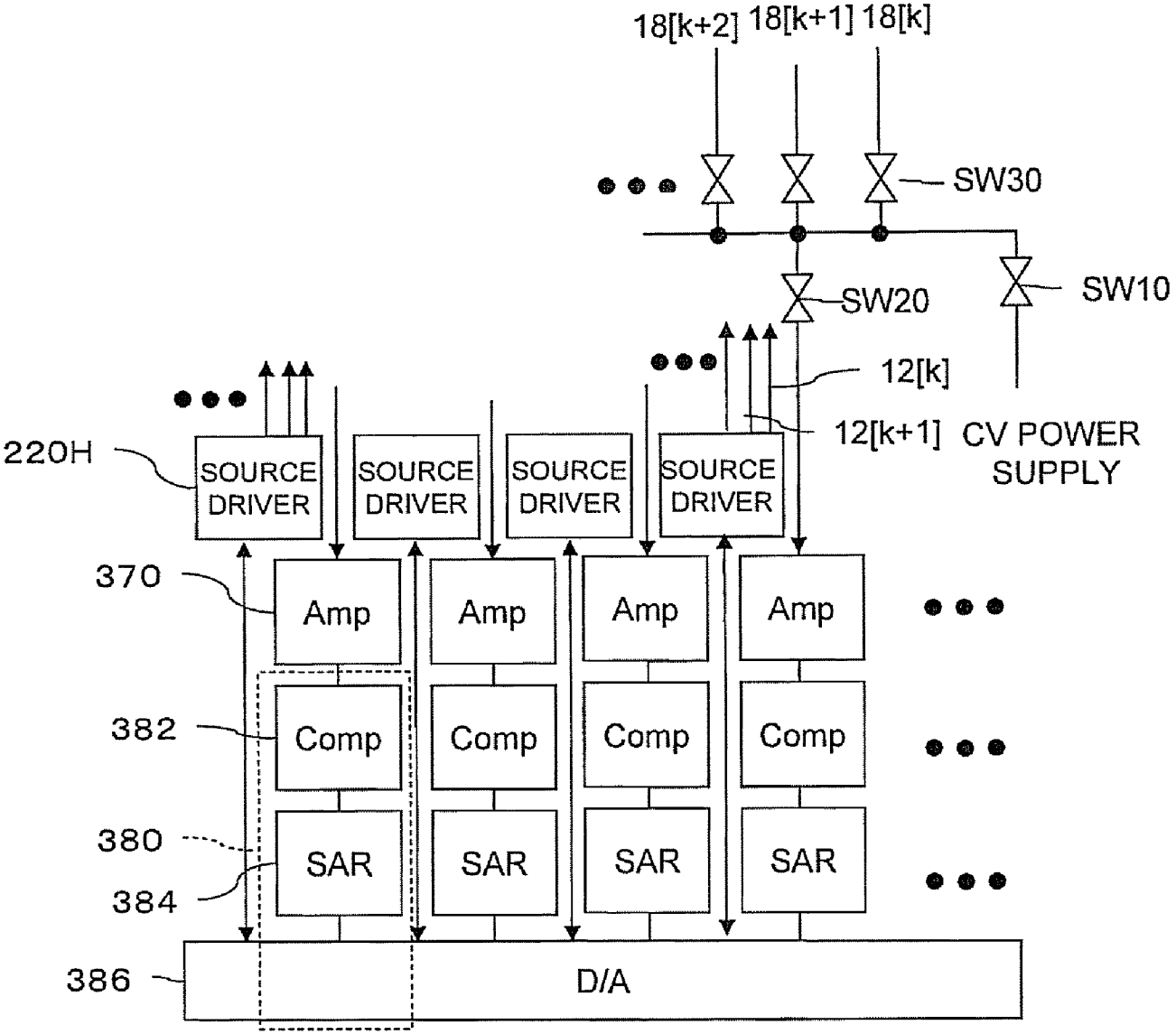
FIG. 8 is a diagram showing an example layout of the current detector and the source driver according to a preferred embodiment of the present invention.

The structure of the cathode current detector 330 according to the present embodiment is next described referring to FIGS. 7 and 8. FIG. 7 shows the configuration of the current detection amplifiers 370 and the AD converters 380 of the cathode current detector 330. FIG. 8 shows a schematic layout of the current detection amplifiers 370, the AD converters 380, and source drivers (H drivers) 220H.

As described above, the current detector 330 is provided in a number such that one current detector 330 is correlated to multiple columns of the matrix of the display section, and the input section of each current detection amplifier 370 is connected to the cathode power supply lines 18 of the correlated multiple columns (for example, when all columns of a QVGA panel are divided into 10 groups, each current detection amplifier 370 is connected to cathode power supply lines 18[*k*]-18[*k*+95]). Between the respective multiple cathode power supply lines 18 and the input terminal of the corresponding current detection amplifier 370, there are provided switches SW30 for selectively supplying inputs from the respective lines 18 to the current detection amplifier 370, and a switch SW20 for collectively controlling connection of the multiple cathode power supply lines 18 to the current detection amplifier 370. Further, between the cathode power supply CV and the cathode power supply lines 18, there is provided a switch SW10 for supplying the cathode power supply to the respective cathode power supply lines 18 during normal operation (i.e., during driving and during inspection signal application).

The successive approximation type AD converter 380 is provided corresponding to each current detection amplifier 370 (i.e., one AD converter 380 is provided in correlation to multiple columns), and comprises a comparator 382, a successive approximation register (SAR) 384, and a digital-analog (DA) converter 386.

The comparator 382 compares the analog detection signal (voltage signal) from the current detection amplifier 370 with an analog reference signal supplied from the DA converter 386, and outputs the comparison result to the successive approximation register 384.

The SAR 384 comprises a plurality of registers in a number equivalent to the number of bits of outputting digital data. The SAR 384 takes into account the comparison signal from the comparator 382 to successively change the data value sequentially from the most significant bit (MSB) side, and supplies the changed data to the DA converter 386.

When a comparison start signal is supplied to the SAR 384 from a controller not shown, the SAR 384 outputs a digital data in which the output from the register assigned to the MSB is set to "1" and the remaining bits are set to "0". The DA converter 386 converts this digital data "10000 . . . " into a corresponding analog signal. This analog signal is supplied as the reference signal to the input terminal of the comparator 382, and is compared with the analog current detection signal supplied from the current detection amplifier 370. When the analog current detection signal is greater than the reference signal, the comparator 382 outputs "1", for example, as the comparison result to the SAR 384. The SAR 384 then outputs a digital data in which the output from the MSB register is fixed to "1", the value in the next bit location is changed from "0" to "1", and the remaining bits are kept unchanged at "0". This digital data is converted into a corresponding analog reference signal in the DA converter 386, supplied to the comparator 382, and again compared with the analog current detection signal from the current detection amplifier 370. As a result of the comparison, when the analog current detection signal is greater than the reference signal, the corresponding comparison output causes the SAR 384 to output a digital data in which the MSB and the second bit are fixed to "1", the third bit is changed from "0" to "1", and the remaining bits are kept unchanged at "0". On the other hand, when the current detection signal is smaller than the reference signal obtained when the second bit is changed to "1", the second bit is changed back to "0", and the third bit is changed. The comparison processing as described above is repeated for a number of times corresponding to the number of bits sequentially from the most significant bit to the least significant bit (LSB), so as to obtain in the SAR 384 the digital signals corresponding to the input analog current detection signals. The obtained digital signals are supplied as digital current detection signals to the subtractor 32 shown in FIG. 4.

Although not shown in FIG. 7, a signal retaining section is provided between the current detection amplifier 370 and the comparator 382. By means of the signal retaining section, the current detection signal is retained during a successive comparison period of the AD converter 386.

As shown in FIGS. 7 and 8, the DA converter 386 is commonly shared by a plurality of AD converters 380. For example, the digital signals from the SARs 384 of the respective AD converters 380 are converted into corresponding analog signals using a common resistor string (R string). As explained above, by commonly sharing the DA converter 386 among the plurality of AD converters 380, area occupied by the AD converters 380 can be reduced. Furthermore, the shared use of the resistor string also serves to prevent generation of variations in analog conversion errors among the AD converters 380.

In the driver (H driver; source driver) 220 for supplying corresponding data signals to the data lines 12 of the display section, the DA converter 260 as shown in FIG. 4 is employed in order to output analog data signals to the display section. According to the present embodiment, the DA converter 260 of the source driver 220H is also implemented by shared use of the DA converter 386 of the AD converter 380. By this further shared use by the DA converter 260 of the source driver, it is possible to further enhance downsizing of the display apparatus. Although the shared use of the DA converters need not be applied to the entire structure, when an R string is employed, shared use of the R string is effective in reducing area of the display apparatus.

According to the present embodiment, one source driver 220H is provided corresponding to every multiple number of columns. In this case, the shared use of the DA converter 386 of the AD converter 380 as the DA converters 260 of the source drivers 220 is particularly effective in reducing the area size. By providing a plurality of source drivers 220H in one display apparatus, the processing of supplying data signals to the display section can be performed in a parallel manner, enabling distribution of the processing load. Further, by allowing the multiple columns correlated to a single source driver 220H to match with the multiple columns correlated to a single current detector 330, and alternately disposing the source driver 220H and the current detector 330 that are correlated to the same columns in an adjacent arrangement as shown in FIG. 8, enhancements in layout and wiring efficiency and reduction of display variation can be facilitated in a case in which these circuits are to be formed within a single integrated circuit or the like.

[Driving Scheme]

Next described is a method for driving the display apparatus according to the present embodiment in which the cathode current inspection based on the above-described principle is carried out. In the driving method described below, an example case is explained in which a high-speed inspection scheme is employed which involves successively applying, as the inspection display signal Vsig supplied to a pixel in the inspected row, an inspection ON display signal (for EL emission) and an inspection OFF display signal (for EL non-emission). Although the order of application of the inspection ON display signal and OFF display signal is not particularly limited, the order in the following example is OFF first and then ON.

Figure 9:
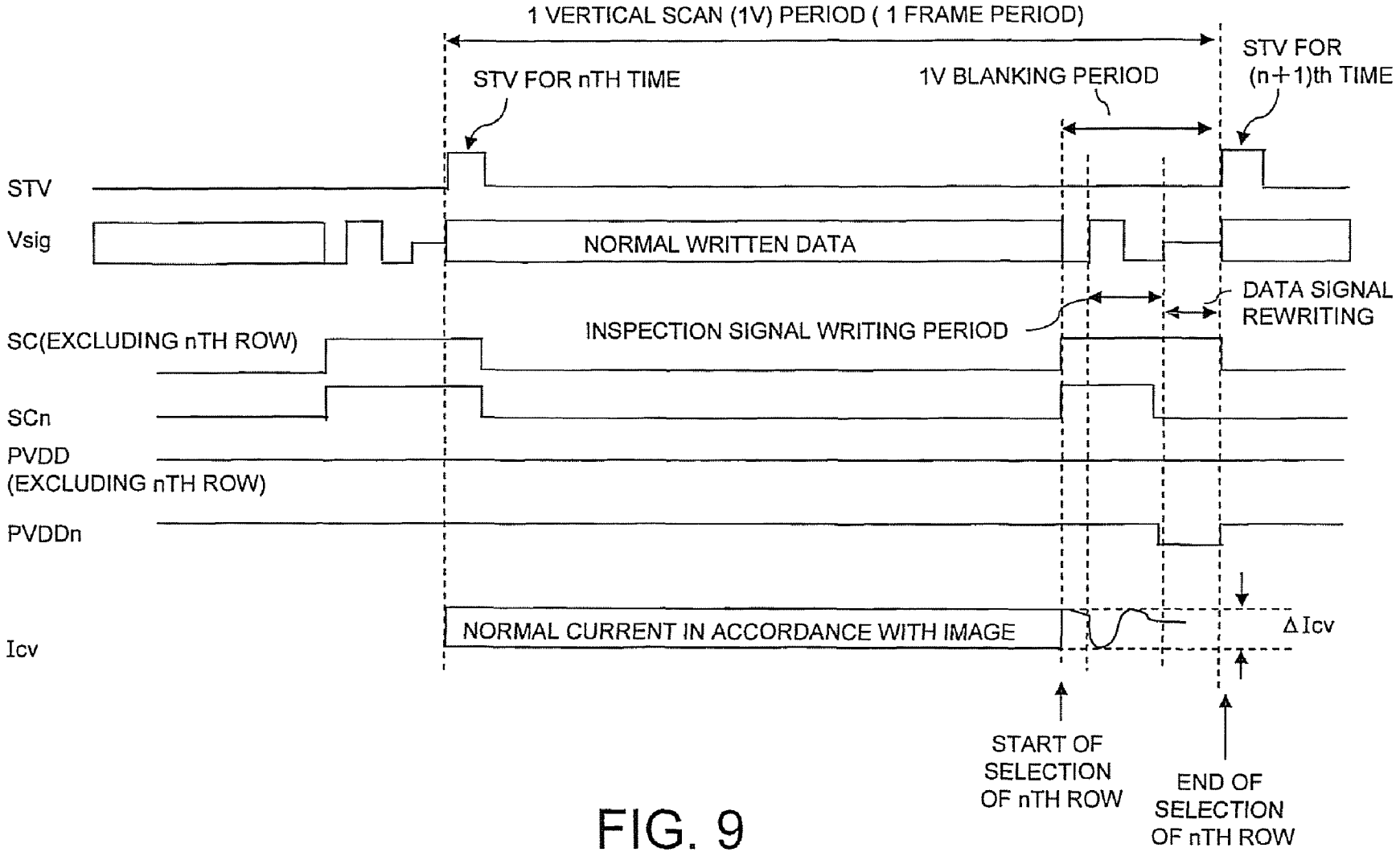
FIG. 9 is a timing chart explaining a driving scheme according to a preferred embodiment of the present invention.

The driving scheme is next described referring to FIG. 9. According to the present scheme, as in the example panel structure shown in FIG. 1 explained above, the cathode electrode is divided corresponding to each column into cathode electrode lines 18 to provide 18[1]-18[*x*]. Further, the cathode current detection is performed as shown in FIG. 9. More specifically, one inspected row (nth row) is selected during one V blanking period within one vertical scan period for nth time, and, from among all the pixels within the nth row (i.e., the nth-row pixels in the first to xth column), each detector 330 detects a cathode current (ΔIcv) value for the pixel in one column among the multiple columns connected to that detector 330. During this process, it is preferable to control such that, concerning the switches SW30 shown in FIGS. 7 and 8, only those in the corresponding inspected columns are set to the closed state.

During a period from after completion of the inspection signal writing period to the end of the corresponding V blanking period, with respect to all the pixels in the nth row, display data signals that were written in the respective pixels until before the inspection are rewritten. In principle, the rewriting need only be performed for the inspected rows. However, in order to perform such selective rewriting, it is necessary to selectively and sequentially perform rewriting with respect to the columns connected to a single current detector 330, and it may be necessary to add a logic circuit or the like to the source driver 220H for that purpose. When such addition of circuits is not desired, write signals can be uniformly executed for all the pixels in the inspected nth row.

Further, according to the present embodiment, potential control of the capacitor lines 14 provided for every row and row-by-row power supply potential control of the power supply lines 16 (PVDD) are carried out. More specifically, during a V blanking period, the capacitor lines 14 are set to the first potential (the non-operation potential of the element driving Tr2), while, during the data signal rewriting period within the vertical blanking period in which nth row is inspected, only the capacitor line 14[*n*] for the inspected row is set to the second potential. Concerning the power supply lines, only the power supply line PVDDn for the inspected row is set to the predetermined LOW level during the data signal rewriting period so as to stop emission by the EL element due to the supplying of the inspection signal. The timings of potential change of the capacitor line 14[*n*] and the power supply line PVDDn are set such that they do not occur during the data signal rewriting period. In particular, the potential change of the capacitance line 14[*n*]) is avoided during data signal rewriting period.

According to the driving scheme described above, during one V period, the cathode current detection can be executed for, from among the pixels in one row, a number of pixels corresponding to the number of divided column groups. Accordingly, in this example, the cathode current detection regarding all pixels can be carried out in approximately 40 seconds, as previously explained. As the cathode electrode is divided corresponding to the respective columns in this driving scheme, the entire duration of 1V blanking period other than the data signal rewriting period can be employed as the inspection period for each one of the columns. As such, it is possible to reduce the work load of the driving circuit that outputs the inspection signals to the data lines 12 and to reduce power consumption.

The cathode electrode lines 18[1]-18[*x*] divided for the respective columns are individually connected to an integrated driving circuit (driving section) 200 mounted on a panel substrate by a COG (Chip On Glass) technique. In the driving section 200, one current detector 330 is provided corresponding to a plurality of columns, as explained above. The cathode current detection for all cathode electrode lines (i.e., all columns) can be carried out in a total amount of time calculated by multiplying the 1V period by the number of divided column groups.

A part or all of the functions of the driver 220 within the driving section 200 shown in FIG. 3 may be formed separately from this COG as an H driver and a V driver which are integrally formed on the panel substrate together with the pixel circuit of the display section.

The above-described driving scheme in which the cathode current lines are provided for the respective columns can also be adopted into a method in which the cathode current detection is performed during a horizontal blanking period within one horizontal scan period, to the extent that the converting speed of the AD converter 380 can support.

[Other Aspects]

While the above scheme and structures are explained referring to a case in which the cathode current detection for each pixel is performed in real time, the current detection and the correction processing may be executed at the time of activating the display apparatus. It is of course possible to measure the cathode current (ΔIcv) for each pixel and store the correction data in advance at the time of shipment from the factory, and to occasionally update the correction data or to perform real-time correction by detecting characteristic variation over time.

In the correction by the variation correcting section 250 described above, the calculation processing and correction processing methods are not particularly limited as long as a data signal supplied to a pixel in which display variation occurs is adjusted to a suitable level and the emission brightness of the EL element is corrected.

By integrating the above-described variation correcting section 300 together with the panel controller 210, it is possible to provide a display apparatus capable of executing the detection and correction of display variation and the control (i.e., display operation) of the display section using a very small driving section. Further, the structures within the variation correcting section 300 such as the AD converter and the memory can be commonly shared with the circuit of the panel controller 210. Forming the driving section 200 into an IC by implementing such sharing can contribute to reduction of the IC chip size.

In the above-described circuit structure, a p-channel TFT is employed as the element driving transistor. However, the present invention is not limited to such a configuration, and, alternatively, an n-channel TFT may be used. In addition, although in the above-described pixel circuit, an example structure is described in which two transistors including a selection transistor and a driving transistor are employed as transistors in a pixel, the present invention is not limited to a structure with two transistors or to the above-described circuit structure.

Moreover, although in the above description, an example configuration is shown in which a cathode current (for example, ΔIcv) of the EL element is used as the current to be measured during inspection of the display variation, the inspection can be executed based on any current Ioled (ΔIoled) flowing through the EL element. As the current Ioled flowing through the EL element, for example, it is also possible to use the anode current Iano in place of the cathode current Icv. When a structure in which the cathode electrode is set as the individual electrode for each pixel of an EL element and the anode electrode is set as the electrode common to a plurality of pixels in each column is employed in place of the structure in which the anode electrode is set as the individual electrode and the cathode electrode is set as the electrode provided for each column, the anode current (ΔIano) which is a current flowing through the column-by-column electrode may be measured.

What is claimed is:

1. An electroluminescence display apparatus, comprising:

a display section having a plurality of pixels arranged in a matrix, and a driving section which controls operation of the display section in accordance with a video signal;

wherein the driving section comprises a driver which carries out row-direction drive and column-direction drive of the display section, a variation detecting section which detects an inspection result of a display variation in each pixel, and a correcting section which corrects the display variation;

each of the plurality of pixels in the display section comprises an electroluminescence element, and an element driving transistor which is connected to the electroluminescence element and controls a current that flows through the electroluminescence element;

in the display section, a plurality of power supply lines for supplying power to electrodes of the electroluminescence elements in the respective pixels are provided along the column direction of the matrix;

the variation detecting section comprises an inspection signal generator which generates an inspection signal to be supplied to a pixel in a row to be inspected and supplies the inspection signal to the pixel in the inspected row, a current detection amplifier which detects a current that flows through the electroluminescence element, and an analog-digital converter which converts an analog current detection signal from the current detection amplifier into a digital signal;

the current detection amplifier is configured to provide one current detection amplifier in correlation to multiple columns of the matrix; wherein a plurality of the current detection amplifier is provided, and each current detection amplifier is connected to the power supply lines; and, during a blanking period, a pixel in a predetermined inspected row is selected by the driver, and a current that flows through the electroluminescence element when an inspection ON signal which serves as the inspection signal and sets the electroluminescence element to an emission level is supplied to the selected pixel is detected by the current detection amplifier via the corresponding power supply line;

the analog-digital converter is configured to provide one successive approximation type analog-digital converter in correlation to the multiple columns in a manner corresponding to the current detection amplifier, wherein a plurality of the analog-digital converter is provided, each analog-digital converter comprising a comparator which compares the analog current detection signal from the current detection amplifier with a reference signal, a successive approximation register which successively changes a data value from higher-order bit side taking into account a comparison signal from the comparator and supplies the changed value to a digital-analog converter, and the digital-analog converter converts a digital signal from the successive approximation register into an analog signal and supplies the converted analog signal as the reference signal to the comparator; and the digital-analog converter is commonly shared by a plurality of the analog-digital converters.

2. The electroluminescence display apparatus as defined in claim 1, wherein the current that flows through the electroluminescence element is a cathode power supply line.

3. The electroluminescence display apparatus as defined in claim 1, wherein the electrode of the electroluminescence element is a cathode electrode, and the power supply line is a cathode power supply line.

4. The electroluminescence display apparatus as defined in claim 1, wherein the driver comprises a digital-analog display data converter which converts a data signal that is in accordance with a display content and is processed as a digital signal into an analog data signal, and supplies the converted analog data signal to each pixel in the display section; and a resistor string of the digital-analog converting section of the successive approximation type analog-digital converters is commonly shared as a resistor string of the digital-analog display data converter.

5. The electroluminescence display apparatus as defined in claim 1, wherein each of the plurality of pixels further comprises a storage capacitor which retains a gate potential of the element driving transistor, a first electrode of the storage capacitor being connected to a gate of the element driving transistor, a second electrode of the storage capacitor being connected to a capacitor line provided for each row;

the driving section includes a capacitor line controller; and the capacitor line controller functions to, during an inspection signal writing period within the blanking period, set a potential of the capacitor line of the inspected row to a first potential that sets the gate potential of the element driving transistor to a non-operation level, and, during a data signal rewriting period until end of the blanking period, set the potential of the capacitor line of the inspected row to a second potential that places the element driving transistor in an operable state.

6. The electroluminescence display apparatus as defined in claim 5, wherein the capacitor line controller further functions to, during the blanking period, fix potentials of all the capacitor lines in the display section other than the capacitor line for the inspected row to the first potential.

7. The electroluminescence display apparatus as defined in claim 1, wherein during the blanking period, the inspection signal generator supplies to the pixel in the inspected row, as the inspection signal, the inspection ON signal and an inspection OFF signal that sets the electroluminescence element to a non-emission level;

the current detection amplifier detects an ON current that flows through the electroluminescence element when the inspection ON signal obtained from the power supply line is applied, and an OFF current obtained when the inspection OFF signal is applied;

the analog-digital converter converts an output from the current detection amplifier into corresponding digital ON current detection signal and digital OFF current detection signal;

a subtractor calculates a difference between the digital ON current detection signal and the digital OFF current detection signal;

the correcting section performs correction using a current difference signal in accordance with the calculated current difference between the digital ON current detection signal and the digital OFF current detection signal.

8. The electroluminescence display apparatus as defined in claim 7, wherein the current that flows through the electroluminescence element is a cathode current.

9. The electroluminescence display apparatus as defined in claim 7, wherein the electrode of the electroluminescence element is a cathode electrode, and the power supply line is a cathode power supply line.

10. The electroluminescence display apparatus as defined in claim 7, wherein the driver comprises a digital-analog display data converter which converts a data signal that is in accordance with a display content and is processed as a digital signal into an analog data signal to be supplied to each pixel in the display section; and a resistor string of the digital-analog converting section of the successive approximation type analog-digital converters is commonly shared as a resistor string of the digital-analog display data converter.

11. The electroluminescence display apparatus as defined in claim 7, wherein each of the plurality of pixels further comprises a storage capacitor which retains a gate potential of the element driving transistor, a first electrode of the storage capacitor being connected to a gate of the element driving transistor, a second electrode of the storage capacitor being connected to a capacitor line provided for each row;

the driving section includes a capacitor line controller; and the capacitor line controller functions to, during an inspection signal writing period within the blanking period, set a potential of the capacitor line of the inspected row to a first potential that sets the gate potential of the element driving transistor to a non-operation level, and, during a data signal rewriting period until end of the blanking period, set the potential of the capacitor line of the inspected row to a second potential that places the element driving transistor in an operable state.

12. The electroluminescence display apparatus as defined in claim 11, wherein the capacitor line controller further functions to, during the blanking period, fix potentials of all the capacitance lines in the display section other than the capacitance line for the inspected row to the first potential.

* * * * *